US010711322B2

(12) United States Patent
Hayashi et al.

(10) Patent No.: US 10,711,322 B2
(45) Date of Patent: Jul. 14, 2020

(54) HOT-PRESSED STEEL SHEET MEMBER, METHOD OF MANUFACTURING THE SAME, AND STEEL SHEET FOR HOT PRESSING

(71) Applicant: NIPPON STEEL & SUMITOMO METAL CORPORATION, Tokyo (JP)

(72) Inventors: Koutarou Hayashi, Tokyo (JP); Toshinobu Nishibata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/267,973

(22) Filed: Feb. 5, 2019

(65) Prior Publication Data

US 2019/0169707 A1 Jun. 6, 2019

Related U.S. Application Data

(62) Division of application No. 15/102,042, filed as application No. PCT/JP2013/085205 on Dec. 27, 2013, now Pat. No. 10,253,387.

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C21D 7/13*** | (2006.01) |
| ***C21D 8/02*** | (2006.01) |
| ***C21D 1/673*** | (2006.01) |
| ***C22C 38/38*** | (2006.01) |
| *C21D 1/18* | (2006.01) |

(52) U.S. Cl.

CPC ..... *C21D 9/46* (2013.01); *C21D 1/673* (2013.01); *C21D 7/13* (2013.01); *C21D 8/0221* (2013.01); *C21D 8/0247* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/38* (2013.01); *C21D 1/18* (2013.01); *C21D 2211/001* (2013.01); *C21D 2211/003* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 2009/0050241 | A1 | 2/2009 | Hashimura et al. | |
| 2014/0230971 | A1 | 8/2014 | Kawasaki et al. | |
| 2015/0010775 | A1 | 1/2015 | Nonaka et al. | |
| 2015/0075680 | A1 | 3/2015 | Tanaka et al. | |
| 2016/0289787 | A1 * | 10/2016 | Takeda | C21D 8/0226 |
| 2018/0291476 | A1 * | 10/2018 | Honda | C21D 9/48 |

FOREIGN PATENT DOCUMENTS

| | | | |
|---|---|---|---|
| CA | 2 770 585 | A1 | 2/2011 |
| CA | 2 780 082 | A1 | 10/2011 |
| CN | 102282280 | A | 12/2011 |
| EP | 2 371 978 | A1 | 10/2011 |
| EP | 2 589 674 | A1 | 5/2013 |
| GB | 1 490 535 | | 11/1977 |
| JP | 10-96031 | A | 4/1998 |
| JP | 2005-126733 | A | 5/2005 |
| JP | 2005-298957 | A | 10/2005 |
| JP | 2006-265583 | A | 10/2006 |
| JP | 2006265583 | A * | 10/2006 |
| JP | 2007-16296 | A | 1/2007 |
| JP | 2007-247001 | A | 9/2007 |
| JP | 2010-65292 | A | 3/2010 |
| JP | 2010-90432 | A | 4/2010 |
| JP | 2010-156032 | A | 7/2010 |
| JP | 2011-99149 | A | 5/2011 |
| JP | 2013-076162 | A | 4/2013 |
| JP | 5329979 | B2 | 8/2013 |
| JP | 2013-216945 | A | 10/2013 |
| JP | 5353642 | B2 * | 11/2013 |
| JP | 2014-37596 | A | 2/2014 |
| JP | 5857913 | B2 | 2/2014 |
| TW | 200415243 | A | 8/2004 |
| TW | 201137130 | A1 | 11/2011 |
| TW | 201335385 | A1 | 9/2013 |

OTHER PUBLICATIONS

Extended European Search Report dated Jun. 22, 2017, in European Patent Application No. 13900389.1.

International Preliminary Report on Patentability and Written Opinion of the International Searching Authority (PCT/IB/338, PCT/IB/373 and PCT/ISA/237) for International Application No. PCT/JP2013/085205, dated Jul. 7, 2016.

International Search Report for PCT/JP2013/085205 dated Apr. 8, 2014.

Notice of Allowance dated Jan. 3, 2019, in U.S. Appl. No. 15/102,042.

Office Action dated Apr. 21, 2017, in Canadian Patent Application No. 2,934,599.

Office Action dated Aug. 14, 2018, in U.S. Appl. No. 15/102,042.

Office Action issued in corresponding Chinese Patent Application No. 201380081889.4 dated Jan. 16, 2017 (8 pages).

(Continued)

*Primary Examiner* — Jenny R Wu

(74) *Attorney, Agent, or Firm* — Birch, Stewart, Kolasch & Birch, LLP

(57) ABSTRACT

A steel sheet for hot pressing includes: a specific chemical composition; and a steel structure comprising ferrite and cementite and represented, in area %: a total area ratio of bainite and martensite: 0% to 10%; and an area ratio of cementite: 1% or more; and a concentration of Mn in the cementite is 5% or more.

7 Claims, No Drawings

(56) References Cited

OTHER PUBLICATIONS

Office Action dated Jun. 13, 2017, in Japanese Patent Application No. 2015-554469, with English translation.
Restriction Requirement dated May 18, 2018, in U.S. Appl. No. 15/102,042.
Written Opinion of the International Searching Authority for PCT/JP2013/085205 (PCT/ISA/237) dated Apr. 8, 2014.
Office Action dated Nov. 19, 2019 in Indian Patent Application No. 201617019891, with English translation.

* cited by examiner

HOT-PRESSED STEEL SHEET MEMBER, METHOD OF MANUFACTURING THE SAME, AND STEEL SHEET FOR HOT PRESSING

CROSS-REFERENCE TO RELATED APPLICATIONS

The present application is a 37 C.F.R. § 1.53(b) Divisional of copending U.S. application Ser. No. 15/102,042 filed Jun. 6, 2016, which is the National Phase under 35 U.S.C. § 371 of International Application No. PCT/JP2013/085205 filed Dec. 27, 2013, all of which are hereby expressly incorporated by reference into the present application.

TECHNICAL FIELD

The present invention relates to a hot-pressed steel sheet member used for a machine structural component and the like, a method for manufacturing the same, and a steel sheet for hot pressing.

BACKGROUND ART

For reduction in weight of an automobile, efforts are advanced to increase the strength of a steel material used for an automobile body and to reduce the weight of steel material used. In a thin steel sheet widely used for the automobile, press formability thereof generally decreases with an increase in strength, making it difficult to manufacture a component having a complicated shape. For example, a highly processed portion fractures with a decrease in ductility, and springback becomes prominent to deteriorate dimensional accuracy. Accordingly, it is difficult to manufacture components by performing press-forming on a high-strength steel sheet, in particular, a steel sheet having a tensile strength of 980 MPa or more. It is easy to process the high-strength steel sheet not by press-forming but by roll-forming, but its application target is limited to a component having a uniform cross section in a longitudinal direction.

Methods called hot pressing intended to obtain high formability in the high-strength steel sheet are described in Patent Literatures 1 and 2. By the hot pressing, it is possible to form the high-strength steel sheet with high accuracy to obtain a high-strength hot-pressed steel sheet member.

On the other hand, the hot-pressed steel sheet member is required to be improved also in ductility. However, steel structure of the steel sheet obtained by the methods described in Patent Literatures 1 and 2 is substantially a martensite single phase, and thus it is difficult for the methods to improve in ductility.

High-strength hot-pressed steel sheet members intended to improve in ductility are described in Patent Literatures 3 and 4, but in these conventional hot-pressed steel sheet members, it has another problem of a decrease in toughness. The decrease in toughness causes a problem not only in the case of the use for an automobile but also in the case of the use for a machine structural component. Patent Literatures 5 and 6 each describe a technique Intended to improve a fatigue property, but even these have difficulty in obtaining sufficient ductility and toughness.

CITATION LIST

Patent Literature

Patent Literature 1: U.K. Patent No. 1490535

Patent Literature 2: Japanese Laid-open Patent Publication No. 10-96031

Patent Literature 3: Japanese Laid-open Patent Publication No. 2010-65292

Patent Literature 4: Japanese Laid-open Patent Publication No. 2007-16296

Patent Literature 5: Japanese Laid-open Patent Publication No. 2007-247001

Patent Literature 6: Japanese Laid-open Patent Publication No. 2005-298957

SUMMARY OF INVENTION

Technical Problem

An object of the present invention is to provide a hot-pressed steel sheet member having excellent ductility and toughness with a high strength, a method of manufacturing the same, and a steel sheet for hot pressing.

Solution to Problem

The inventors of the present application studied the reason why the decrease in toughness is caused by the conventional high-strength hot-pressed steel sheet member intended to improve ductility. As a result, it became clear that when a multi-phase structure containing ferrite and martensite is to be made as the steel structure of the hot-pressed steel sheet member for the purpose of improving ductility, decarburization is likely to progress and a decrease in toughness by the decarburization is caused during heating and air cooling in hot pressing for obtaining the hot-pressed steel sheet member. That is, it became clear that the ferrite ratio increases in a region ranging from the surface of the hot-pressed steel sheet member to 15 μm or so in depth due to the decarburization, and a layer structure substantially made of a ferrite single phase (hereinafter, to be sometimes referred to as a "ferrite layer") sometimes appears, for example, and embrittlement of ferrite grain boundaries in the region induces significant deterioration of toughness. The decarburization is significant particularly when obtaining a multi-phase structure, but the decarburization has not been recognized before.

As a result of earnest studies based on such findings, the inventors of the present application have found that a hot-pressed steel sheet member having a steel structure being a multi-phase structure containing ferrite and martensite, and having a surface layer portion in which decarburization is suppressed can be obtained by treating a steel sheet for hot pressing having a chemical composition containing specific amounts of C and Mn and relatively large amount of Si, and having a specific steel structure including hot pressing under specific conditions. Further, the inventors of the present application also have found that this hot-pressed steel sheet member has a high tensile strength of 980 MPa or more and also has excellent ductility and toughness. The inventors of the present application also have found that this hot-pressed steel sheet member also has an excellent fatigue property beyond expectation. Then, the inventors of the present application has reached the following various aspects of the invention.

(1) A steel sheet for hot pressing, including:

a chemical composition represented by, in mass %:

C: 0.10% to 0.34%;

Si: 0.5% to 2.0%;

Mn: 1.0% to 3.0%;

sol. Al: 0.001% to 1.0% or less;

P: 0.05% or less;

S: 0.01% or less;

N: 0.01% or less;

Ti: 0% to 0.20%;

Nb: 0% to 0.20%;

V: 0% to 0.20%;

Cr: 0% to 1.0%;

Mo: 0% to 1.0%;

Cu: 0% to 1.0%;

Ni: 0% to 1.0%;

Ca: 0% to 0.01%;

Mg: 0% to 0.01%;

REM: 0% to 0.01%;

Zr: 0% to 0.01%;

B: 0% to 0.01%;

Bi: 0% to 0.01%; and balance: Fe and impurities; and a steel structure containing ferrite and cementite, represented, in area %:

a total area ratio of bainite and martensite: 0% to 10%; and an area ratio of cementite: 1% or more, and wherein a concentration of Mn in the cementite is 5% or more.

(2) The steel sheet for hot pressing according to (1), wherein the chemical composition contains one or more selected from the group consisting of, in mass %:

Ti: 0.003% to 0.20%;

Nb: 0.003% to 0.20%;

V: 0.003% to 0.20%;

Cr: 0.005% to 1.0%;

Mo: 0.005% to 1.0%;

Cu: 0.005% to 1.0%; and

Ni: 0.005% to 1.0%.

(3) The steel sheet for hot pressing according to (1)—, wherein the chemical composition contains one or more selected from the group consisting of, in mass %:

Ca: 0.0003% to 0.01%;

Mg: 0.0003% to 0.01%;

REM: 0.0003% to 0.01%; and

Zr: 0.0003% to 0.01%.

(4) The steel sheet for hot pressing according to (1), wherein the chemical composition contains, in mass %, B: 0.0003% to 0.01%.

(5) The steel sheet for hot pressing according to (1), wherein the chemical composition contains, in mass %, Bi: 0.0003% to 0.01%.

(6) A method of manufacturing a hot-pressed steel sheet member, including:

a step of heating the steel sheet for hot pressing according to (1) in a temperature zone of 720° C. to an Acs point so as to cause a concentration of Mn in austenite to be equal to or more than 1.20 times a concentration of Mn in the ferrite; and a step of hot pressing and cooling down to an Ms point at an average cooling rate of 10° C./second to 500° C./second after the heating, wherein a reduced C content on a surface of the steel sheet for hot pressing during a time period from completion of the step of heating to start of the step of hot pressing is less than 0.0005 mass %.

(7) The method of manufacturing the hot-pressed steel sheet member according to (6), wherein a time period for which the steel sheet for hot pressing is exposed to the atmosphere during the time period from completion of the step of heating to start of the step of hot pressing is less than 15 seconds.

Advantageous Effects of Invention

According to the present invention, it is possible to obtain excellent ductility and toughness while obtaining a high tensile strength.

DESCRIPTION OF EMBODIMENTS

Hereinafter, embodiments of the present invention will be described. The embodiments of the present invention relate to a hot-pressed steel sheet member having a tensile strength of 980 MPa or more.

First, chemical compositions of the hot-pressed steel sheet member (hereinafter, sometimes referred to as a "steel sheet member") according to the embodiment of the present invention and a steel sheet for hot pressing used for manufacturing the same will be described. In the following description, "%" being a unit of a content of each element contained in the steel sheet member or the steel sheet for hot pressing means "mass %" unless otherwise specified.

The chemical composition of the steel sheet member according to the embodiment and the steel sheet for hot pressing used for manufacturing the same is represented by, in mass %, C: 0.10% to 0.34%, Si: 0.5% to 2.0%, Mn: 1.0% to 3.0%, sol. Al: 0.001% to 1.0%, P: 0.05% or less, S: 0.01% or less, N: 0.01% or less, Ti: 0% to 0.20%, Nb: 0% to 0.20%, V: 0% to 0.20%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi: 0% to 0.01%, and balance: Fe and impurities. Examples of the impurities include ones contained in raw materials such as ore and scrap, and ones mixed in during a manufacturing process.

(C: 0.10% to 0.34%)

C is a very important element which increases hardenability of the steel sheet for hot pressing and mainly determines the strength of the steel sheet member. When the C content of the steel sheet member is less than 0.10%, it may be difficult to secure the tensile strength of 980 MPa or more. Accordingly, the C content of the steel sheet member is 0.10% or more. The C content of the steel sheet member is preferably 0.12% or more. When the C content of the steel sheet member is greater than 0.34%, martensite in the steel sheet member may become hard and deterioration of toughness may be significant. Thus, the C content of the steel sheet member is 0.34% or less. In terms of improving weldability, the C content of the steel sheet member is preferably 0.30% or less, and more preferably 0.25% or less. As will be described later, decarburization sometimes occurs in manufacturing of the hot-pressed steel sheet member, but the amount of the decarburization is negligibly small, and therefore the C content of the steel sheet for hot pressing substantially corresponds to the C content of the steel sheet member.

(Si: 0.5% to 2.0%)

Si is a very effective element for improving ductility of the steel sheet member and stably securing strength of the steel sheet member. When the Si content is less than 0.5%, it may be difficult to obtain the above-described effects. Thus, the Si content is 0.5% or more. When the Si content is greater than 2.0%, the above-described effect may be saturated to result in economical disadvantage, and plating wettability significantly decreases to frequently cause unplating. Thus, the Si content is 2.0% or less. In terms of improving weldability, the Si content is preferably 0.7% or more, and more preferably 1.1% or more. In terms of suppressing surface defects of the steel sheet member, the Si content is preferably 1.8% or less, and more preferably 1.35% or less.

(Mn: 1.0% to 3.0%)

Mn is a very effective element for improving hardenability of the steel sheet for hot pressing and securing strength of the steel sheet member. When the Mn content is less than 1.0%, it may be very difficult to secure a tensile strength of 980 MPa or more in the steel sheet member. Thus, the Mn content is 1.0% or more. For more securely obtaining the above-described effects, the Mn content is preferably 1.1% or more, and more preferably 1.15% or more. When the Mn content is greater than 3.0%, the steel structure of the steel sheet member may become a significant band structure and deterioration of bendability and crashworthiness may become significant. Thus, the Mn content is 3.0% or less. In terms of productivity in hot-rolling and cold-rolling for obtaining the steel sheet for hot pressing, the Mn content is preferably 2.5% or less, and more preferably 2.45% or less.

(Sol. Al (Acid-Soluble Al): 0.001% to 1.0%)

Al is an element having an effect of deoxidizing steel to make steel material better. When the sol. Al content is less than 0.001%, it may be difficult to obtain the above-described effect. Thus, the sol. Al content is 0.001% or more. In order to more securely obtain the above-described effect, the sol. Al content is preferably 0.015% or more. When the sol. Al content is greater than 1.0%, the weldability significantly may decrease, oxide-based inclusions may increase, and the surface property may significantly deteriorate. Thus, the sol. Al content is 1.0% or less. In order to obtain better surface property, the sol. Al content is preferably 0.080% or less.

(P: 0.05% or Less)

P is not an essential element and is contained, for example, as an impurity in steel. In terms of weldability, a lower P content is better. In particular, when the P content is more than 0.05%, the weldability may significantly decrease. Thus, the P content is 0.05% or less. In order to secure better weldability, the P content is preferably 0.018% or less. On the other hand, P has an effect of enhancing the strength of the steel by solid solution strengthening. To obtain the effect, 0.003% or more of P may be contained.

(S: 0.01% or Less)

S is not an essential element and is contained, for example, as an impurity in steel. In terms of the weldability, a lower S content is better. In particular, when the S content is more than 0.01%, the weldability may significantly decrease. Thus, the S content is 0.01% or less. In order to secure better weldability, the S content is preferably 0.003% or less, and more preferably 0.0015% or less.

(N: 0.01% or less)

N is not an essential element and is contained, for example, as an impurity in steel. In terms of the weldability, a lower N content is better. In particular, when the N content is more than 0.01%, the weldability may significantly decrease. Thus, the N content is 0.01% or less. In order to secure better weldability, the N content is preferably 0.006% or less.

Ti, Nb, V, Cr, Mo, Cu, Ni, Ca, Mg, REM, Zr, B, and Bi are not essential elements, and are arbitrary elements which may be appropriately contained, up to a specific amount as a limit, in the steel sheet member and the steel sheet for hot pressing.

(Ti: 0% to 0.20%, Nb: 0% to 0.20%, V: 0% to 0.20%, Cr: 0% to 1.0%, Mo: 0% to 1.0%, Cu: 0% to 1.0%, and Ni: 0% to 1.0%)

Each of Ti, Nb, V, Cr, Mo, Cu, and Ni is an element effective for stably securing strength of the steel sheet member. Thus, one or more selected from the group consisting of these elements may also be contained. However, when the content of one of Ti, Nb, and V is more than 0.20%, hot-rolling and cold-rolling for obtaining the steel sheet for hot pressing may become difficult to be performed, and further it may become difficult to stably secure strength. Thus, the Ti content, the Nb content, and the V content are each 0.20% or less. When the Cr content is greater than 1.0%, it may become difficult to stably secure strength. Thus, the Cr content is 1.0% or less. When the Mo content is greater than 1.0%, hot-rolling and cold-rolling for obtaining the steel sheet for hot pressing may become difficult to be performed. Thus, the Mo content is 1.0% or less. When the content of one of Cu and Ni is 1.0%, the above-described effects may be saturated to result in economical disadvantage, and hot-rolling and cold-rolling for obtaining the steel sheet for hot pressing may become difficult to be performed. Thus, the Cu content and the Ni content are each 1.0% or less. In order to stably secure the strength of the steel sheet member, each of the Ti content, the Nb content, and the V content is preferably 0.003% or more, and each of the Cr content, the Mo content, the Cu content, and the Ni content is preferably 0.005% or more. That is, at least one of "Ti: 0.003% to 0.20%," "Nb: 0.003% to 0.20%," "V: 0.003% to 0.20%," "Cr: 0.005% to 1.0%," "Mo: 0.005% to 1.0%," "Cu: 0.005% to 1.0%," and "Ni: 0.005% to 1.0%" is preferably satisfied.

(Ca: 0% to 0.01%, Mg: 0% to 0.01%, REM: 0% to 0.01%, and Zr: 0% to 0.01%)

Each of Ca, Mg, REM, and Zr is an element which has an effect of contributing to control of inclusions, in particular, fine dispersion of inclusions to enhance toughness. Thus, one or more selected from the group consisting of these elements may be contained. However, when the content of any one of them is more than 0.01%, the deterioration in surface property may become obvious. Thus, each of the Ca content, the Mg content, the REM content, and the Zr content is 0.01% or less. In order to improve the toughness, each of the Ca content, the Mg content, the REM content, and the Zr content is preferably 0.0003% or more. That is, at least one of "Ca: 0.0003% to 0.01%," "Mg: 0.0003% to 0.01%," "REM: 0.0003% to 0.01%," and "Zr: 0.0003% to 0.01%" is preferably satisfied.

REM (rare-earth metal) indicates 17 kinds of elements in total of Sc, Y, and lanthanoid, and the "REM content" means a total content of these 17 kinds of elements. Lanthanoid is industrially added as a form of, for example, misch metal.

(B: 0% to 0.01%)

B is an element having an effect to enhance toughness of the steel sheet. Thus, B may be contained. However, when the B content is more than 0.01%, hot workability may deteriorate, and hot-rolling for obtaining the steel sheet for hot pressing may become difficult. Thus, the B content is 0.01% or less. In order to improve the toughness, the B content is preferably 0.0003% or more. That is, the B content is preferably 0.0003% to 0.01%.

(Bi: 0% to 0.01%)

Bi is an element having an effect to uniformize the steel structure and enhance crashworthiness. Thus, Bi may be contained. However, when the Bi content is more than 0.01%, hot workability may deteriorate, and hot-rolling for obtaining the steel sheet for hot pressing may become difficult. Thus, the Bi content is 0.01% or less. In order to improve the crashworthiness, the Bi content is preferably 0.0003% or more. That is, the Bi content is preferably 0.0003% to 0.01%.

Next, the steel structure of the steel sheet member according to the embodiment will be described. This steel sheet member includes a steel structure in which an area ratio of ferrite in a surface layer portion ranging from the surface to 15 μm in depth is equal to or less than 1.20 times an area ratio of ferrite in an inner layer portion being a portion excluding the surface layer portion, and the inner layer portion includes the steel structure represented, in area %, ferrite: 10% to 70% and martensite: 30% to 90%, a total area ratio of ferrite and martensite: 90% to 100%. In the inner layer portion, the concentration of Mn in the martensite is equal to or more than 1.20 times the concentration of Mn in the ferrite in the inner layer portion. The surface layer portion of the steel sheet member means a surface portion ranging from the surface to 15 μm in depth, and the inner layer portion means a portion excluding this surface layer portion. That is, the inner layer portion is a portion other than the surface layer portion of the steel sheet member. Each of numerical values relating to the steel structure of the inner layer portion is, for example, an average value of the whole of the inner layer portion in a thickness direction, but it may be represented by a numerical value relating to the steel structure at a point where the depth from the surface of the steel sheet member is ¼ of the thickness of the steel sheet member (hereinafter, this point is sometimes referred to as a "¼ depth position"). For example, when the thickness of the steel sheet member is 2.0 mm, it may be represented by a numerical value at a point positioned at 0.50 mm in depth from the surface. This is because the steel structure at the ¼ depth position indicates an average steel structure in the thickness direction of the steel sheet member. Thus, in the present invention, the area ratio of ferrite and the area ratio of martensite measured at the ¼ depth position are regarded as an area ratio of ferrite and an area ratio of martensite in the inner layer portion respectively. The reason why the surface layer portion is determined as a surface portion ranging from the surface to 15 μm in depth is because the maximum depth in a range where decarburization occurs is nearly 15 μm within the studies by the inventors of the present application.

(Area Ratio of Ferrite in the Surface Layer Portion: Equal to or Less than 1.20 Times the Area Ratio of Ferrite in the Inner Layer Portion)

When the area ratio of ferrite in the surface layer portion is greater than 1.20 times the area ratio of ferrite in the inner layer portion, ferrite grain boundaries in the surface layer portion may be vulnerable and the toughness may be significantly low. Thus, the area ratio of ferrite in the surface layer portion is equal to or less than 1.20 times the area ratio of ferrite in the inner layer portion. The area ratio of ferrite in the surface layer portion is preferably equal to or less than 1.18 times the area ratio of ferrite in the inner layer portion. When the steel sheet for hot pressing according to the embodiment of the present invention is used to be subjected to hot pressing under a later-described condition, decarburization does not easily occur, and therefore the area ratio of ferrite in the surface layer portion of the steel sheet member is likely to be equal to or less than 1.16 times the area ratio of ferrite in the inner layer portion.

A treatment to increase the concentration of C in the vicinity of the surface of the steel sheet such as a carburization treatment is not performed in heating in conventional hot pressing. Thus, the area ratio of ferrite in the surface layer portion does not normally become less than the area ratio of ferrite in the inner layer portion, and the area ratio of ferrite in the surface layer portion is equal to or more than 1.0 time the area ratio of ferrite in the inner layer portion.

(Area Ratio of Ferrite in the Inner Layer Portion: 10% to 70%)

A specific amount of ferrite is made to exist in the inner layer portion, thereby making it possible to obtain good ductility. When the area ratio of ferrite in the inner layer portion is less than 10%, most of the ferrite may be isolated, to make it difficult to obtain good ductility. Thus, the area ratio of ferrite in the inner layer portion is 10% or more. When the area ratio of ferrite in the inner layer portion is greater than 70%, martensite being a strengthening phase may not be sufficiently secured and it may be difficult to secure a tensile strength of 980 MPa or more. Thus, the area ratio of ferrite in the inner layer portion is 70% or less. For securing better ductility, the area ratio of ferrite in the inner layer portion is preferably 30% or more.

(Area Ratio of Martensite in the Inner Layer Portion: 30% to 90%)

A specific amount of martensite is made to exist in the inner layer portion, thereby making it possible to obtain a high strength. When the area ratio of martensite in the inner layer portion is less than 30%, it may be difficult to secure a tensile strength of 980 MPa or more. Thus, the area ratio of martensite in the inner layer portion is 30% or more. When the area ratio of martensite in the inner layer portion is greater than 90%, the area ratio of ferrite becomes less than 10%, resulting in that it may be difficult to obtain good ductility as described above. Thus, the area ratio of martensite in the inner layer portion is 90% or less. For securing better ductility, the area ratio of martensite in the inner layer portion is preferably 70% or less.

(Total Area Ratio of Ferrite and Martensite in the Inner Layer Portion: 90% to 100%)

The inner layer portion of the hot-pressed steel sheet member according to the embodiment is preferably composed of ferrite and martensite, namely, the total area ratio of ferrite and martensite is preferably 100%. However, depending on the manufacturing conditions, one or more selected from the group consisting of bainite, retained austenite, cementite, and pearlite may be contained as a phase or a structure other than ferrite and martensite. In this case, when the area ratio of the phase or the structure other than ferrite and martensite is greater than 10%, target properties may not be obtained in some cases due to the influence of the phase or the structure. Accordingly, the area ratio of the phase or the structure other than ferrite and martensite in the inner layer portion is 10% or less. That is, the total area ratio of ferrite and martensite in the inner layer portion is 90% or more.

As a method of measuring the area ratio of each phase in the above steel structure, a method well-known to the skilled person in the art may be employed. Each of the area ratios is obtained, for example, as an average value of a value measured in a cross section perpendicular to a rolling direction and a value measured in a cross section perpendicular to a sheet width direction (a direction perpendicular to the rolling direction). In other words, the area ratio is obtained, for example, as an average value of area ratios measured in two cross sections.

(Concentration of Mn in the Martensite in the Inner Layer Portion: Equal to or More than 1.20 Times the Concentration of Mn in the Ferrite in the Inner Layer Portion)

When the concentration of Mn in the martensite in the inner layer portion is less than 1.20 times the concentration of Mn in the ferrite in the inner layer portion, the area ratio of ferrite in the surface layer portion is high inevitably, resulting in that good toughness may not be obtained. Thus, the concentration of Mn in the martensite in the inner layer portion is equal to or more than 1.20 times the concentration of Mn in the ferrite in the inner layer portion. The upper limit of this ratio is not limited in particular, but the ratio does not exceed 3.0.

The steel sheet member can be manufactured by treating a specific steel sheet for hot pressing under specific conditions.

Here, a steel structure and the like in the steel sheet for hot pressing used for manufacturing the steel sheet member according to the embodiment will be described. This steel sheet for hot pressing includes a steel structure containing ferrite and cementite with the total area ratio of bainite and martensite of 0% to 10% and an area ratio of cementite of 1% or more. The concentration of Mn in the cementite is 5% or more.

(Ferrite and Cementite)

Ferrite and cementite may exist in a manner to be contained in pearlite, or may also exist independently of pearlite. As an example of the steel structure of the steel sheet for hot pressing, a multi-phase structure of ferrite and pearlite, and a multi-phase structure of ferrite, pearlite, and spheroidized cementite are cited. The steel structure of the steel sheet for hot pressing may also further contain martensite. When the total area ratio of ferrite and cementite is less than 90%, decarburization may be likely to occur during hot pressing. Thus, the total area ratio of ferrite and cementite is preferably 90% or more including the ferrite and cementite contained in pearlite.

(Area Ratio of Cementite: 1% or More)

When the area ratio of cementite is less than 1%, decarburization may be likely to occur during hot pressing, resulting in that good toughness may not be easily obtained in the hot-pressed steel sheet member obtained from this steel sheet for hot pressing. Thus, the area ratio of cementite is 1% or more.

(Total Area Ratio of Bainite and Martensite: 0% to 10%)

When the total area ratio of bainite and martensite is greater than 10%, decarburization may be very likely to occur during hot pressing, resulting in that good toughness may not be obtained in the hot-pressed steel sheet member obtained from this steel sheet for hot pressing. Thus, the total area ratio of bainite and martensite is 10% or less. Bainite and martensite need not to be contained. Then, when the total area ratio of bainite and martensite is 10% or less, good toughness may be obtained in the hot-pressed steel sheet member as long as ferrite and cementite are contained.

(Concentration of Mn in the Cementite: 5% or more)

When the concentration of Mn in the cementite is less than 5%, decarburization may be likely to occur during hot pressing, resulting in that good toughness may not be obtained in the hot-pressed steel sheet member obtained from this steel sheet for hot pressing. Thus, the concentration of Mn in the cementite is 5% or more.

Next, a method of manufacturing the steel sheet member according to the embodiment, namely, a method of treating the steel sheet for hot pressing will be described. In the treatment of the steel sheet for hot pressing, the steel sheet for hot pressing is heated in a temperature zone of 720° C. to an $Ac_3$ point, the concentration of Mn in austenite is caused to be equal to or more than 1.20 times the concentration of Mn in the ferrite, hot pressing and cooling down to an Ms point at an average cooling rate of 10° C./second to 500° C./second is performed after the heating. A reduced C content on a surface of the steel sheet for hot pressing during a time period from completion of the heating to start of the hot pressing is less than 0.0005 mass %.

(Heating Temperature of the Steel Sheet for Hot Pressing: A Temperature Zone of 720° C. to an $Ac_3$ Point)

The steel sheet to be subjected to hot pressing, namely, the steel sheet for hot pressing is heated in a temperature zone of 720° C. to the $Ac_3$ point. The $Ac_3$ point is a temperature (unit: ° C.) at which the steel structure becomes an austenite single phase, which is calculated by the following empirical formula (i).

$$Ac_3=910-203\times(C^{0.5})-15.2\times Ni+44.7\times Si+104\times V+31.5\times Mo-30\times Mn-11\times Cr-20\times Cu+700\times P+400\times Al+50\times Ti \quad (i)$$

Here, the element symbol in the above formula indicates the content (unit: mass %) of each element in a chemical composition of the steel sheet.

When the heating temperature is less than 720° C., formation of austenite accompanying solid solution of cementite may be difficult or insufficient, resulting in a difficulty in making the tensile strength of the steel sheet member become 980 MPa or more. Thus, the heating temperature is 720° C. or more. When the heating temperature is greater than the $Ac_3$ point, the steel structure of the steel sheet member may become a martensite single phase, resulting in significant deterioration of ductility. Thus, the heating temperature is the $Ac_3$ point or less.

The heating rate up to the temperature zone of 720° C. to the $Ac_3$ point and the heating time for holding at the above-described temperature zone are not limited in particular, but they are each preferably within the following range.

An average heating rate in the heating up to the temperature zone of 720° C. to the $Ac_3$ point is preferably 0.2° C./second to 100° C./second. Setting the average heating rate to 0.2° C./second or more makes it possible to secure higher productivity. Further, setting the average heating rate to 100° C./second or less makes it easy to control the heating temperature when it is heated by using a normal furnace.

Particularly, the average heating rate in a temperature zone of 600° C. to 720° C. is preferably 0.2° C./second to 10° C./second. This is to more promote distribution of Mn between the ferrite and the austenite, more promote concentration of Mn in the austenite, and to suppress decarburization more securely.

The heating time in the temperature zone of 720° C. to the $Ac_3$ point is preferably 3 minutes to 10 minutes. The heating time is a time period from the time which the temperature of the steel sheet reaches 720° C. to a time of completion of the heating. The time of the completion of the heating, specifically, is the time which the steel sheet is taken out of the heating furnace in the case of furnace heating, and is the time which energization or the like is turned off in the case of energization heating or induction heating. The heating time is 3 minutes or more, and thereby the distribution of Mn between the ferrite and the austenite is promoted more securely and the concentrating of Mn in the austenite is more promoted, resulting in that decarburization is further suppressed. Therefore, the area ratio of ferrite in the surface layer portion of the steel sheet member becomes likely to be equal to or less than 1.20 times the area ratio of ferrite in the inner layer portion. The heating time is 10 minutes or less, and thereby the steel structure of the steel sheet member can be made finer, resulting in a further improvement in crashworthiness of the steel sheet member.

(Concentration of Mn in the Austenite: Equal to or More than 1.20 Times the Concentration of Mn in the Ferrite)

The concentration of Mn in the austenite is caused to be equal to or more than 1.2 times the concentration of Mn in the ferrite by the completion of the heating. The austenite is more stabilized and decarburization becomes very unlikely to occur in hot pressing by causing the concentration of Mn in the austenite to be equal to or more than 1.2 times the concentration of Mn in the ferrite. When the concentration of Mn in the austenite is not caused to be equal to or more than 1.2 times the concentration of Mn in the ferrite, namely when the concentration of Mn in the austenite is less than 1.2 times the concentration of Mn in the ferrite at the heating end time, the distribution of Mn between the ferrite and the austenite may not be promoted sufficiently, and therefore the austenite is likely to be decomposed, and decarburization may progress easily while the steel sheet is exposed to the atmosphere during a time period from the completion of the heating to start of the hot pressing. Thus, the concentration of Mn in the austenite is caused to be equal to or more than 1.2 times the concentration of Mn in the ferrite by the completion of the heating. The upper limit of this ratio is not limited in particular, but the ratio does not exceed 3.0. The concentration of Mn in the austenite and the concentration of Mn in the ferrite may be adjusted by the chemical composition and the steel structure of the steel sheet for hot pressing and the heating condition. For example, the heating time in the temperature zone of 720° C. to the $Ac_3$ point is prolonged, thereby making it possible to promote concentrating of Mn in the austenite.

(A Reduced C Content on the Surface of the Steel Sheet for Hot Pressing During the Time Period from the Completion of the Heating to Start of the Hot Pressing: Less than 0.0005%)

When the reduced C content on the surface of the steel sheet for hot pressing during this time period is 0.0005% or more, it may be difficult to make the area ratio of ferrite in the surface layer portion of the steel sheet member become equal to or less than 1.20 times the area ratio of ferrite in the inner layer portion due to an influence of decarburization. Therefore, it may be difficult to obtain sufficient toughness in the steel sheet member. Thus, this reduced C content is less than 0.0005%. The reduced C content can be measured by using a glow discharge spectroscope (GDS) or an electron probe micro analyzer (EPMA), for example. That is, a surface of the steel sheet for hot pressing is analyzed at the time of the completion of the heating and at the hot pressing start time and results of the analyses are compared, and thereby the reduced C content can be found.

A method of adjusting the reduced C content is not limited in particular. For example, the steel sheet is sometimes exposed to the atmosphere between extraction from a heating apparatus such as a heating furnace used for the above-described heating and input into a hot pressing apparatus, but this time period is preferably as short as possible and is preferably less than 15 seconds at longest, and is more preferably 10 seconds or less. This is because when this time period is 15 seconds or more, decarburization may progress and the area ratio of ferrite in the surface layer portion of the steel sheet member may increase.

Adjustment of this time period can be performed by controlling a transfer time from extraction from the heating apparatus to a press die of the hot pressing apparatus, for example.

(Average Cooling Rate Down to the Ms Point: Not Less than 10° C./Second Nor More than 500° C./Second)

After the heating, hot pressing and cooling down to the Ms point at an average cooling rate of 10° C./second to 500° C./second is performed. When the average cooling rate is less than 10° C./second, diffusional transformation such as bainite transformation may progress excessively to thereby make it difficult to secure the area ratio of martensite being a strengthening phase, resulting in a difficulty in making the tensile strength of the steel sheet member become 980 MPa or more. Thus, the average cooling rate is 10° C./second or more. When the average cooling rate is greater than 500° C./second, it may become very difficult to hold homogenization of the member, resulting in that strength is no longer stabilized. Thus, the average cooling rate is 500° C./second or less.

In this cooling, heat generation by phase transformation is likely to extremely increase after the temperature reaches 400° C. Therefore, when the cooling in a low temperature zone of less than 400° C. is performed by the same method as the cooling in a temperature zone of 400° C. or more, it may be difficult to secure a sufficient average cooling rate in some cases. It is preferable to perform the cooling down to the Ms point from 400° C. more forcibly than the cooling down to 400° C. For example, it is preferable to employ the following method.

Generally, the cooling in the hot pressing is performed by setting a die made of steel used for forming a heated steel sheet to normal temperature or a temperature of about several tens of degrees centigrade in advance and bringing the steel sheet into contact with the die. Accordingly, the average cooling rate can be controlled, for example, by change in heat capacity with the change in dimension of the die. The average cooling rate can be also controlled by changing the material of the die to a different metal (for example, Cu or the like). The average cooling rate can be also controlled by using a water-cooling die and changing the amount of cooling water flowing through the die. The average cooling rate can be also controlled by forming a plurality of grooves in the die in advance and passing water through the grooves during hot pressing. The average cooling rate can be also controlled by raising a hot pressing machine in the middle of hot pressing and passing water through its space. The average cooling rate can be also controlled by adjusting a die clearance and changing a contact area of the die with the steel sheet.

Examples of the method of increasing the cooling rate at around 400° C. and below include the following three kinds.

(a) Immediately after reaching 400° C., the steel sheet is moved to a die different in heat capacity or a die at room temperature.

(b) A water-cooling die is used and the water flow rate through the die is increased immediately after reaching 400° C.

(c) Immediately after reaching 400° C., water is passed between the die and the steel sheet. In this method, the cooling rate may be further increased by increasing the quantity of water according to temperature.

The mode of the forming in the hot pressing in the embodiment is not particularly limited. Examples of the mode of the forming include bending, drawing, bulging, hole expansion, and flanging. The mode of the forming may be appropriately selected depending on the kind of a target steel sheet member. Representative examples of the steel sheet member include a door guard bar, a bumper reinforcement and the like which are automobile reinforcing components. The hot forming is not limited to the hot pressing as long as the steel sheet can be cooled simultaneously with forming or immediately after forming. For example, roll forming may be performed as the hot forming.

Such a series of treatments are performed on the above-described steel sheet for hot pressing, thereby the steel sheet member according to the embodiment can be manufactured. In other words, it is possible to obtain a hot-pressed steel sheet member having a desired steel structure, a tensile strength of 980 MPa or more, and excellent ductility and toughness.

For example, the ductility can be evaluated by a total elongation (EL) in a tensile test, and the total elongation in the tensile test is preferably 12% or more in the embodiment. The total elongation is more preferably 14% or more.

After the hot pressing and cooling, shot blasting may be performed. By the shot blasting, scale can be removed. The shot blasting also has an effect of introducing a compressive stress into the surface of the steel sheet member, and therefore effects of suppressing delayed fracture and improving a fatigue strength can be also obtained.

In the above-described method of manufacturing the steel sheet member, the hot pressing is not accompanied by preforming, the steel sheet for hot pressing is heated to the temperature zone of 720° C. to the Ac; point to cause austenite transformation to some extent, and then is formed. Thus, the mechanical properties of the steel sheet for hot pressing at room temperature before heating are not important. Therefore, as the steel sheet for hot pressing, for example, a hot-rolled steel sheet, a cold-rolled steel sheet, a plated steel sheet and the like may be used. Examples of the hot-rolled steel sheet include one containing a multi-phase structure of ferrite and pearlite and one containing spheroidized cementite after spheroidizing annealing at a temperature of 650° C. to 700° C. Examples of the cold-rolled steel sheet include a full hard material and an annealed material. Examples of the plated steel sheet include an aluminum plated steel sheet and a zinc plated steel sheet. Their manufacturing methods are not particularly limited. When the hot-rolled steel sheet or the full hard material is used, the distribution of Mn during heating of the hot pressing is more likely to be promoted in the case of the steel structure being a multi-phase structure of ferrite and pearlite. When the annealed material is used, the distribution of Mn during heating of the hot pressing is more likely to be promoted when an annealing temperature is in a ferrite and austenite two-phase temperature zone.

The steel sheet member according to the embodiment can also be manufactured by going through hot pressing with preforming. For example, in a range where the above-described conditions of the heating, the decarburization treatment, and the cooling are satisfied, the hot-pressed steel sheet member may be manufactured by preforming by press working of the steel sheet for hot pressing using a die in a specific shape, putting it into the same type of die, applying a pressing force thereto, and rapidly cooling it. Also in this case, the kind of the steel sheet for hot pressing and its steel structure are not limited, but it is preferable to use a steel sheet that has a strength as low as possible and has ductility. For example, the tensile strength is preferably 700 MPa or less. A coiling temperature after the hot-rolling of the hot-rolled steel sheet is preferably 450° C. or higher in order to obtain a soft steel sheet, and is preferably 700° C. or lower in order to reduce scale loss. In the cold-rolled steel sheet, annealing is preferable to obtain a soft steel sheet, and the annealing temperature is preferably an $Ac_1$ point to an Acs point. The average cooling rate down to room temperature after annealing is preferably an upper critical cooling rate or lower.

It should be noted that the above-described embodiment merely illustrates a concrete example of implementing the present invention, and the technical scope of the present invention is not to be construed in a restrictive manner by the embodiment. That is, the present invention may be implemented in various forms without departing from the technical spirit or main features thereof.

EXAMPLE

Next, the experiment performed by the inventors of the present application will be described. In this experiment, first, 17 kinds of steel materials having chemical compositions listed in Table 1 were used to fabricate 24 kinds of steel sheets for hot pressing (steel sheets to be subjected to a heat treatment) having steel structures listed in Table 2. The balance of each steel material was Fe and impurities. Further, area ratios of ferrite and cementite contained in pearlite are also included in the total area ratio of ferrite and cementite in Table 2. In the fabrication of the steel sheet to be subjected to a heat treatment, first, slabs prepared in a laboratory were each heated at 1250° C. for 30 minutes and hot rolled to 2.6 mm in thickness at a temperature of 900° C. or more. Then, the resultant products were each cooled down to 600° C. using a water spray and charged into a furnace to be held for 30 minutes at 600° C. Thereafter, slow cooling was performed down to the room temperature at 20° C./hour. This cooling process is one simulating a coiling step in hot rolling. The steel structures of hot-rolled steel sheets obtained as above each were a multi-phase structure of ferrite and pearlite.

Next, scales were removed from each of the hot-rolled steel sheets, and then the hot-rolled steel sheets were each cold rolled to 1.2 mm in thickness, excluding a sample material No. 21 by pickling. As for a sample material No. 6, a cold-rolled steel sheet obtained by the cold rolling was annealed in an austenite single-phase region after the cold rolling. As for a sample material No. 19, a cold-rolled steel sheet obtained by the cold rolling was annealed in a ferrite and austenite two-phase region after the cold rolling, and further was subjected to hot-dip galvanizing with a coating weight per one side of 60 $g/m^2$.

As for the sample material No. 21, scales were removed from the hot-rolled steel sheet by pickling, and thereafter spheroidizing annealing was performed. In this spheroidizing annealing, the hot-rolled steel sheet was held at 650° C. for 5 hours.

After the fabrication of the steel sheets to be subjected to a heat treatment, the steel sheets were heated in a gas heating furnace with an air-fuel ratio of 0.85 under conditions listed in Table 2. In Table 2, "HEATING TIME" indicates a time period from when the steel sheet is charged into the gas heating furnace and then the temperature of the steel sheet reaches 720° C. to when the steel sheet is taken out of the gas heating furnace. In Table 2, "HEATING TEMPERATURE" indicates not the temperature of the steel sheet but the temperature inside the gas heating furnace. Then, the steel sheets were each taken out of the gas heating furnace, air cooling was performed for various time periods, hot pressing of each of the steel sheets was performed, and the steel sheets were each cooled after the hot pressing. In the hot pressing, a flat die made of steel was used. That is, forming was not performed. When cooling the steel sheet, the steel sheet was cooled down to the Ms point at an average cooling rate listed in Table 2 with leaving the steel sheet in contact with the die, and further cooled down to 150° C., and then the steel sheet was taken out of the die to let the steel sheet cool. When cooling down to 150° C., the periphery of the die was cooled by cooling water until the temperature of the steel sheet became 150° C., or a die adjusted to the normal temperature was prepared, and then the steel sheet was held in the die until the temperature of the steel sheet became 150° C. In a measurement of the average cooling rate down to 150° C., a thermocouple was attached to the steel sheet in advance, and temperature history of the steel sheet was analyzed. In this manner, 24 types of sample materials (sample steel sheets) were fabricated. The sample material (sample steel sheet) is sometimes referred to as a "hot-pressed steel sheet" below.

TABLE 1

| STEEL MATERIAL SYMBOL | CHEMICAL COMPOSITION (MASS %) C | Si | Mn | P | S | sol. Al | N | Ti | Nb | V |
|---|---|---|---|---|---|---|---|---|---|---|
| A | 0.162 | 1.25 | 2.38 | 0.012 | 0.0009 | 0.030 | 0.0046 | — | — | — |
| B | 0.150 | 1.18 | 0.81 | 0.011 | 0.0014 | 0.029 | 0.0043 | — | — | — |
| C | 0.154 | 1.24 | 1.51 | 0.010 | 0.0012 | 0.041 | 0.0044 | 0.07 | 0.05 | — |
| D | 0.153 | 1.21 | 1.62 | 0.009 | 0.0012 | 0.032 | 0.0045 | — | — | — |
| E | 0.154 | 1.23 | 1.59 | 0.011 | 0.0011 | 0.029 | 0.0045 | — | — | — |
| F | 0.161 | 1.18 | 2.44 | 0.012 | 0.0009 | 0.031 | 0.0042 | — | — | — |
| G | 0.158 | 1.22 | 2.37 | 0.009 | 0.0013 | 0.034 | 0.0047 | — | — | — |
| H | 0.202 | 0.23 | 1.56 | 0.014 | 0.0012 | 0.042 | 0.0045 | — | — | — |
| I | 0.159 | 1.19 | 2.03 | 0.011 | 0.0014 | 0.032 | 0.0043 | — | — | — |
| J | 0.150 | 1.22 | 1.98 | 0.013 | 0.0012 | 0.035 | 0.0041 | — | — | — |
| K | 0.197 | 1.20 | 1.16 | 0.014 | 0.0012 | 0.036 | 0.0042 | — | — | — |
| L | 0.199 | 1.21 | 1.24 | 0.012 | 0.0010 | 0.027 | 0.0043 | — | — | — |
| M | 0.201 | 1.23 | 1.62 | 0.008 | 0.0011 | 0.038 | 0.0038 | — | — | — |
| N | 0.180 | 0.82 | 1.78 | 0.013 | 0.0011 | 0.029 | 0.0042 | — | — | — |
| O | 0.083 | 1.03 | 1.54 | 0.013 | 0.0011 | 0.036 | 0.0048 | — | — | — |
| P | 0.124 | 1.33 | 2.02 | 0.014 | 0.0014 | 0.033 | 0.0042 | — | — | 0.03 |
| Q | 0.153 | 1.23 | 2.13 | 0.011 | 0.0013 | 0.037 | 0.0040 | — | — | — |

| STEEL MATERIAL SYMBOL | CHEMICAL COMPOSITION (MASS %) Cr | Mo | Cu | Ni | Ca | Mg | REM | Zr | B | Bi | Ac3 (° C.) |
|---|---|---|---|---|---|---|---|---|---|---|---|
| A | — | — | — | — | — | — | — | — | — | 0.001 | 833 |
| B | — | — | — | — | — | — | — | — | — | — | 879 |
| C | — | — | — | — | — | — | — | — | — | — | 867 |
| D | — | — | — | — | — | — | — | — | — | — | 855 |
| E | — | — | — | — | — | — | — | 0.002 | — | — | 857 |
| F | — | — | — | — | — | — | 0.002 | — | — | — | 829 |
| G | — | — | 0.1 | 0.1 | 0.002 | — | — | — | — | — | 829 |
| H | — | — | — | — | — | — | — | — | — | — | 809 |
| I | — | — | — | — | — | — | — | — | — | — | 842 |
| J | — | — | — | — | — | 0.002 | — | — | — | — | 850 |
| K | — | — | — | — | — | — | — | — | — | — | 863 |
| L | — | 0.1 | — | — | — | — | — | — | — | — | 859 |
| M | — | — | — | — | — | — | — | — | — | — | 846 |
| N | 0.3 | — | — | — | — | — | — | — | — | — | 825 |
| O | — | — | — | — | — | — | — | — | — | — | 875 |
| P | — | — | — | — | — | — | — | — | — | — | 863 |
| Q | — | — | — | — | — | — | — | — | 0.001 | — | 844 |

UNDERLINE INDICATES THAT VALUE IS OUTSIDE THE RANGE OF THE PRESENT INVENTION

TABLE 2

| SAMPLE MATERIAL No. | STEEL MATERIAL SYMBOL | STEEL SHEET SUBJECTED TO HEAT TREATMENT TYPE | CEMENTITE AREA RATIO (%) | Mn CONCENTRATION IN CEMENTITE (MASS %) | TOTAL AREA RATIO OF BAINITE AND MARTENSITE (%) | TOTAL AREA RATIO OF FERRITE AND CEMENTITE |
|---|---|---|---|---|---|---|
| 1 | A | FULL HARD | 1.8 | 16 | 8 | 92 |
| 2 | B | FULL HARD | 1.8 | 7 | 1 | 99 |
| 3 | C | FULL HARD | 1.9 | 11 | 5 | 95 |
| 4 | D | FULL HARD | 1.9 | 12 | 4 | 96 |
| 5 | D | FULL HARD | 1.8 | 10 | 5 | 95 |
| 6 | D | COLD-ROLLED STEEL SHEET (ANNEALED IN SINGLE PHASE ZONE) | 1.6 | 2.3 | 48 | 52 |
| 7 | D | FULL HARD | 1.8 | 11 | 6 | 94 |
| 8 | E | FULL HARD | 1.9 | 11 | 3 | 97 |
| 9 | F | FULL HARD | 2.1 | 10 | 9 | 94 |
| 10 | G | FULL HARD | 2.0 | 16 | 4 | 96 |
| 11 | H | FULL HARD | 2.6 | 12 | 3 | 97 |
| 12 | I | FULL HARD | 1.9 | 14 | 6 | 94 |
| 13 | J | FULL HARD | 1.8 | 15 | 9 | 91 |
| 14 | J | FULL HARD | 1.9 | 15 | 8 | 92 |
| 15 | K | FULL HARD | 2.7 | 9.4 | 3 | 97 |
| 16 | K | FULL HARD | 2.6 | 9.2 | 6 | 94 |
| 17 | L | FULL HARD | 2.5 | 9.1 | 3 | 97 |
| 18 | M | FULL HARD | 2.4 | 11 | 6 | 94 |

TABLE 2-continued

| | | | | | | |
|---|---|---|---|---|---|---|
| 19 | N | PLATED STEEL SHEET (ANNEALED IN TWO PHASE ZONE) | 2.4 | 13 | 9 | 91 |
| 20 | O | FULL HARD | 0.9 | 7.1 | 5 | 95 |
| 21 | P | HOT-ROLLED STEEL SHEET (SPHEROIDIZING ANNEALED) | G | 6.9 | 0 | 100 |
| 22 | Q | FULL HARD | 2.1 | 14 | 9 | 91 |
| 23 | A | COLD-ROLLED STEEL SHEET (ANNEALED IN TWO PHASE ZONE) | 0.0 | NOT CALCULATED | 23 | 77 |
| 24 | P | FULL HARD | 1.3 | 4.2 | 8 | 92 |

| SAMPLE | HEATING CONDITION | | | | | AIR | COOLING AFTER HOT PRESSING |
|---|---|---|---|---|---|---|---|
| | HEATING RATE (° C./SEC) | | HEATING | HEATING | | COOLING | AVERAGE |
| MATERIAL No. | ROOM TEMPERATURE TO 720° C. | 600° C.~720° C. | TEMPERATURE (° C.) | TIME (MIN) | DECARBURIZED AMOUNT | TIME (SEC) | COOLNG RATE (° C./SEC) |
| 1 | 15 | 8 | 750 | 6 | 0.0001 | 4 | 70 |
| 2 | 15 | 8 | 750 | 5 | 0.0003 | 4 | 70 |
| 3 | 15 | 8 | 800 | 6 | 0.0003 | 4 | 70 |
| 4 | 15 | 8 | 700 | 6 | 0.0003 | 4 | 70 |
| 5 | 15 | 8 | 800 | 6 | 0.0002 | 4 | 70 |
| 6 | 15 | 8 | 800 | 4 | 0.0008 | 4 | 70 |
| 7 | 15 | 8 | 800 | 6 | 0.0003 | 4 | 5 |
| 8 | 15 | 8 | 840 | 5 | 0.0002 | 4 | 70 |
| 9 | 15 | 8 | 750 | 6 | 0.0001 | 4 | 70 |
| 10 | 15 | 8 | 800 | 7 | 0.0002 | 4 | 70 |
| 11 | 15 | 8 | 750 | 6 | 0.0004 | 4 | 70 |
| 12 | 15 | 8 | 800 | 7 | 0.0001 | 4 | 70 |
| 13 | 15 | 8 | 800 | 4 | 0.0002 | 4 | 70 |
| 14 | 15 | 8 | 900 | 8 | 0.0003 | 4 | 70 |
| 15 | 15 | 8 | 800 | 7 | 0.0002 | 4 | 70 |
| 16 | 15 | 8 | 800 | 7 | 0.0012 | 25 | 70 |
| 17 | 15 | 8 | 800 | 7 | 0.0001 | 4 | 70 |
| 18 | 15 | 8 | 800 | 6 | 0.0002 | 4 | 70 |
| 19 | 15 | 8 | 760 | 6 | 0.0002 | 4 | 70 |
| 20 | 15 | 8 | 800 | 7 | 0.0008 | 4 | 70 |
| 21 | 15 | 8 | 800 | 8 | 0.0003 | 4 | 70 |
| 22 | 15 | 8 | 800 | 7 | 0.0002 | 4 | 70 |
| 23 | 15 | 8 | 750 | 6 | 0.0007 | 4 | 70 |
| 24 | 15 | 8 | 800 | 8 | 0.0009 | 4 | 70 |

UNDERLINE INDICATES THAT VALUE IS OUTSIDE THE RANGE OF THE PRESENT INVENTION

After the hot-pressed steel sheets were obtained, regarding each of these steel sheets, an area ratio of ferrite in the surface layer portion, an area ratio of ferrite in the inner layer portion, and an area ratio of martensite in the inner layer portion were found. These area ratios each are an average value of values calculated by performing an image analysis of optical microscope observation images or electron microscope observation images of two cross sections: a cross section perpendicular to the rolling direction; and a cross section perpendicular to the sheet width direction (direction perpendicular to the rolling direction). In an observation of the steel structure of the surface layer portion, the region ranging from the surface of the steel sheet to 15 μm in depth was observed. In an observation of the steel structure of the inner layer portion, it was observed at the ¼ depth position. The ratio of the area ratio of ferrite in the surface layer portion to the area ratio of ferrite in the inner layer portion, and the area ratio of ferrite and the area ratio of martensite in the inner layer portion are listed in Table 3.

The mechanical properties of the hot-pressed steel sheets were also examined. In this examination, measurements of a tensile strength (TS) and total elongation (EL), and evaluation of toughness were performed. In the measurements of the tensile strength and the total elongation, a JIS No. 5 tensile test piece was taken from each of the steel sheets in a direction perpendicular to the rolling direction to be subjected to a tensile test. In the evaluation of toughness, a Charpy impact test was performed at 0° C. to measure a percentage brittle fracture. In a fabrication of samples for the Charpy impact test, four V-notch test pieces were taken from each of the steel sheets, and these were stacked to be screwed together. These examination results are also listed in Table 3. Regarding each of the hot-pressed steel sheets, hot pressing using a flat die made of steel was performed, but forming was not performed at the time of hot pressing. However, the mechanical properties of each of these hot-pressed steel sheets reflect mechanical properties of the hot-pressed steel sheet member fabricated by being subjected to the same thermal history as that of the hot pressing in this experiment at the time of forming. That is, as long as the thermal history is substantially the same regardless of whether or not forming is performed at the time of hot pressing, the mechanical properties thereafter become substantially the same.

The concentration of Mn in ferrite and the concentration of Mn in austenite immediately after the heating were measured by using an electron probe micro analyzer (EPMA). In this measurement, heating under the conditions listed in Table 2 was performed in the gas heating furnace and water cooling was performed immediately after being taken out of the gas heating furnace in order to hold the steel structure immediately after the heating. By this water cooling, the austenite was transformed into martensite without diffusion and the ferrite was held as it was. Thus, the concentration of Mn in the ferrite after the water cooling corresponded to the concentration of Mn in the ferrite immediately after the heating, and the concentration of Mn in the martensite after the water cooling corresponded to the concentration of Mn in the austenite immediately after the heating. Then, the ratio of the concentration of Mn in the austenite to the concentration of Mn in the ferrite (Mn ratio) was calculated. This result is also listed in Table 3.

As listed in Table 3, the sample materials No. 1, No. 3, No. 5, No. 8 to No. 10, No. 12, No. 13, No. 15, No. 17 to No. 19, No. 21, and No. 22 each being a present invention example exhibited excellent ductility and toughness. That is, a tensile strength of 980 MPa or more (TS), total elongation of 12% or more (EL), and a percentage brittle fracture of 10% or less were obtained.

On the other hand, in the sample material No. 2, a tensile strength of 980 MPa or more was not obtained after cooling

TABLE 3

| SAMPLE MATERIAL No. | STEEL MATERIAL SYMBOL | RATIO BETWEEN FERRITE AREA RATIOS (SURFACE LAYER PORTION/INNER LAYER PORTION) | STEEL STRUCTURE OF INNER LAYER PORTION | |
|---|---|---|---|---|
| | | | FERRITE AREA RATIO (%) | MARTENSITE AREA RATIO (%) |
| 1 | A | 1.09 | 67 | 33 |
| 2 | B | 1.05 | 73 | 16 |
| 3 | C | 1.05 | 65 | 35 |
| 4 | D | 1.00 | 96 | 0 |
| 5 | D | 1.06 | 63 | 37 |
| 6 | D | 1.26 | 58 | 42 |
| 7 | D | 1.03 | 60 | 21 |
| 8 | E | 1.12 | 43 | 57 |
| 9 | F | 1.07 | 68 | 32 |
| 10 | G | 1.03 | 34 | 66 |
| 11 | H | 1.08 | 64 | 36 |
| 12 | I | 1.05 | 42 | 58 |
| 13 | J | 1.16 | 44 | 56 |
| 14 | J | NOT CALCULATED | 0 | 100 |
| 15 | K | 1.10 | 61 | 39 |
| 16 | K | 1.24 | 68 | 32 |
| 17 | L | 1.05 | 65 | 35 |
| 18 | M | 1.03 | 36 | 64 |
| 19 | N | 1.06 | 63 | 37 |
| 20 | O | 1.39 | 68 | 32 |
| 21 | P | 1.00 | 47 | 53 |
| 22 | Q | 1.13 | 38 | 62 |
| 23 | A | 1.25 | 68 | 32 |
| 24 | P | 1.24 | 49 | 51 |

| SAMPLE MATERIAL No. | Mn RATIO | TS (MPa) | EL (%) | PERCENTAGE BRITTLE FRACTURE (%) | NOTE |
|---|---|---|---|---|---|
| 1 | 1.24 | 1012 | 13.4 | 5 | INVENTION EXAMPLE |
| 2 | 1.23 | 898 | 22.5 | 0 | COMPARATIVE EXAMPLE |
| 3 | 1.26 | 1033 | 13.2 | 5 | INVENTION EXAMPLE |
| 4 | NOT CALCULATED | 584 | 30.3 | 5 | COMPARATIVE EXAMPLE |
| 5 | 1.25 | 1148 | 16.1 | 5 | INVENTION EXAMPLE |
| 6 | 1.13 | 1158 | 15.4 | 25 | COMPARATIVE EXAMPLE |
| 7 | 1.26 | 792 | 23.9 | 5 | COMPARATIVE EXAMPLE |
| 8 | 1.24 | 1196 | 12.8 | 0 | INVENTION EXAMPLE |
| 9 | 1.24 | 1032 | 12.7 | 5 | INVENTION EXAMPLE |
| 10 | 1.27 | 1295 | 13.5 | 5 | INVENTION EXAMPLE |
| 11 | 1.24 | 1024 | 10.3 | 0 | COMPARATIVE EXAMPLE |
| 12 | 1.26 | 1282 | 12.8 | 0 | INVENTION EXAMPLE |
| 13 | 1.21 | 1211 | 15.3 | 0 | INVENTION EXAMPLE |
| 14 | NOT CALCULATED | 1473 | 8.2 | 0 | COMPARATIVE EXAMPLE |
| 15 | 1.23 | 1045 | 14.2 | 5 | INVENTION EXAMPLE |
| 16 | 1.23 | 1006 | 16.3 | 20 | COMPARATIVE EXAMPLE |
| 17 | 1.25 | 1121 | 14.0 | 0 | INVENTION EXAMPLE |
| 18 | 1.26 | 1285 | 13.5 | 0 | INVENTION EXAMPLE |
| 19 | 1.25 | 1025 | 12.7 | 0 | INVENTION EXAMPLE |
| 20 | 1.26 | 942 | 15.8 | 15 | COMPARATIVE EXAMPLE |
| 21 | 1.27 | 1250 | 12.2 | 0 | INVENTION EXAMPLE |
| 22 | 1.22 | 1293 | 12.9 | 5 | INVENTION EXAMPLE |
| 23 | 1.22 | 1023 | 13.5 | 15 | COMPARATIVE EXAMPLE |
| 24 | 1.24 | 1228 | 13.2 | 20 | COMPARATIVE EXAMPLE |

UNDERLINE INDICATES THAT VALUE IS OUTSIDE THE RANGE OF THE PRESENT INVENTION (after annealing) because the chemical composition was outside the range of the present invention. In the sample materials No. 4 and No. 7, a desired steel structure was not obtained and a tensile strength of 980 MPa or more was not obtained after cooling (after annealing) because the manufacturing condition was outside the range of the present invention and the steel structure after hot pressing was also outside the range of the present invention. In the sample material No. 6, excessive decarburization occurred because the steel structure of the steel sheet to be subjected to a heat treatment was outside the range of the present invention. That is, the manufacturing condition was outside the range of the present invention. The steel structure after hot pressing was also outside the range of the present invention. Therefore, a desired steel structure was not obtained and the percentage brittle fracture was greater than 10%. In the sample material 11, the total elongation was less than 12% because the chemical composition was outside the range of the present invention. In the sample material No. 14, the total elongation was less than 12% because the manufacturing condition was outside the range of the present invention and the steel structure after hot pressing was also outside the range of the present invention. In the sample material No. 16, a desired steel structure was not obtained and the percentage brittle fracture was greater than 10% because the manufacturing condition was outside the range of the present invention and the steel structure after hot pressing was also outside the range of the present invention. In the sample material No. 20, a tensile strength of 980 MPa or more was not obtained after cooling (after annealing) because the chemical composition was outside the range of the present invention. Further, excessive decarburization occurred because the steel structure of the steel sheet to be subjected to a heat treatment was outside the range of the present invention. That is, the manufacturing condition was outside the range of the present invention. Therefore, a desired steel structure was not obtained and the percentage brittle fracture was greater than 10%. In the sample material No. 23, excessive decarburization occurred because the steel structure of the steel sheet to be subjected to a heat treatment was outside the range of the present invention. That is, the manufacturing condition was outside the range of the present invention. Therefore, a desired steel structure was not obtained and the percentage brittle fracture was greater than 10%. In the sample material No. 24, excessive decarburization occurred because the concentration of Mn in the cementite of the steel sheet to be subjected to a heat treatment was outside the range of the present invention. That is, the manufacturing condition was outside the range of the present invention. Therefore, a desired steel structure was not obtained and the percentage brittle fracture was greater than 10%.

INDUSTRIAL APPLICABILITY

The present invention may be used for, for example, industries of manufacturing and using automobile body structural components and so on in which importance is placed on excellent ductility and toughness. The present invention may be used also for industries of manufacturing and using other machine structural components, and so on.

The invention claimed is:

1. A steel sheet for hot pressing, comprising:

a chemical composition represented by, in mass %:

C: 0.10% to 0.34%;
Si: 0.5% to 2.0%;
Mn: 1.0% to 3.0%;
sol. Al: 0.001% to 1.0% or less;
P: 0.05% or less;
S: 0.01% or less;
N: 0.01% or less;
Ti: 0% to 0.20%;
Nb: 0% to 0.20%;
V: 0% to 0.20%;
Cr: 0% to 1.0%;
Mo: 0% to 1.0%;
Cu: 0% to 1.0%;
Ni: 0% to 1.0%;
Ca: 0% to 0.01%;
Mg: 0% to 0.01%;
REM: 0% to 0.01%;
Zr: 0% to 0.01%;
B: 0% to 0.01%;
Bi: 0% to 0.01%; and
balance: Fe and impurities; and a steel structure comprising ferrite and cementite, represented, in area %:

a total area ratio of bainite and martensite: 0% to 10%; and an area ratio of cementite: 1% or more, and wherein a concentration of Mn in the cementite is 5 mass % or more.

2. The steel sheet for hot pressing according to claim 1, wherein the chemical composition comprises one or more selected from, in mass %:

Ti: 0.003% to 0.20%;
Nb: 0.003% to 0.20%;
V: 0.003% to 0.20%;
Cr: 0.005% to 1.0%;
Mo: 0.005% to 1.0%;
Cu: 0.005% to 1.0%; and
Ni: 0.005% to 1.0%.

3. The steel sheet for hot pressing according to claim 1, wherein the chemical composition comprises one or more selected from, in mass %:

Ca: 0.0003% to 0.01%;
Mg: 0.0003% to 0.01%;
REM: 0.0003% to 0.01%; and
Zr: 0.0003% to 0.01%.

4. The steel sheet for hot pressing according to claim 1, wherein the chemical composition comprises, in mass %, B: 0.0003% to 0.01%.

5. The steel sheet for hot pressing according to claim 1, wherein the chemical composition comprises, in mass %, Bi: 0.0003% to 0.01%.

6. A method of manufacturing a hot-pressed steel sheet member, comprising:

a step of heating the steel sheet for hot pressing according to claim 1 in a temperature zone of 720° C. to an $Ac_3$ point for causing a concentration of Mn in austenite to be equal to or more than 1.20 times a concentration of Mn in the ferrite; and a step of hot pressing and cooling down to an Ms point at an average cooling rate of 10° C./second to 500° C./second after the heating, wherein a reduced C content on a surface of the steel sheet for hot pressing during a time period from completion of the step of heating to start of the step of hot pressing is less than 0.0005 mass %.

7. The method of manufacturing the hot-pressed steel sheet member according to claim 6, wherein a time period for which the steel sheet for hot pressing is exposed to the atmosphere during the time period from completion of the step of heating to start of the step of hot pressing is less than 15 seconds.

* * * * *